US009570248B2

(12) United States Patent
Raith et al.

(10) Patent No.: US 9,570,248 B2
(45) Date of Patent: Feb. 14, 2017

(54) LINEAR SELECTOR

(71) Applicant: Maschinenfabrik Reinhausen GmbH, Regensburg (DE)

(72) Inventors: Andreas Raith, Kirchberg (DE); Andreas Eberle, Barbing (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/766,906

(22) PCT Filed: Jan. 23, 2014

(86) PCT No.: PCT/EP2014/051338

§ 371 (c)(1),
(2) Date: Aug. 10, 2015

(87) PCT Pub. No.: WO2014/135302

PCT Pub. Date: Sep. 12, 2014

(65) Prior Publication Data

US 2016/0005554 A1 Jan. 7, 2016

(30) Foreign Application Priority Data

Mar. 8, 2013 (DE) ..... 10 2013 102 299

(51) Int. Cl.
*H01H 9/00* (2006.01)

(52) U.S. Cl.
CPC ..... *H01H 9/0016* (2013.01); *H01H 9/0005* (2013.01); *H01H 9/0027* (2013.01)

(58) Field of Classification Search
CPC ... H01H 9/0005; H01H 9/0027; H01H 9/0016
USPC ..... 200/11 TC, 18, 571, 275, 61.54, 504, 200/11 G; 218/147; 333/107, 262
See application file for complete search history.

(56) References Cited

U.S. PATENT DOCUMENTS

| | | | | |
|---|---|---|---|---|
| 4,532,386 | A * | 7/1985 | Muench, Jr. | H01H 9/0011 200/11 TC |
| 5,191,179 | A | 3/1993 | Yatchum | |
| 6,825,426 | B2 * | 11/2004 | Muench | H01H 19/12 200/11 R |
| 6,849,813 | B1 * | 2/2005 | Albrecht | H01H 9/0044 200/11 TC |
| 7,649,147 | B2 * | 1/2010 | Xiao | H01H 9/0005 200/11 TC |

FOREIGN PATENT DOCUMENTS

| | | |
|---|---|---|
| DE | 892176 B | 10/1953 |
| DE | 900248 B | 12/1953 |
| DE | 913933 B | 6/1954 |
| DE | 9308424 U | 3/1994 |

* cited by examiner

*Primary Examiner* — Edwin A. Leon
(74) *Attorney, Agent, or Firm* — Andrew Wilford

(57) ABSTRACT

The invention relates to a linear selector (1) for power-free preselection of tap contacts for a tapped transformer (100). The linear selector (1) according to the invention is cost-effective, simple and compactly constructed. The functions of a selector and a reverser are thus better connected. The linear selector (1) is constructed from a fine selector (2) and a reversing switch (3). The fine selector (2) and the reversing switch (3) are directly driven via a common gear unit (6).

10 Claims, 5 Drawing Sheets

LINEAR SELECTOR

CROSS REFERENCE TO RELATED APPLICATIONS

This application is the US-national stage of PCT application PCT/EP2014/051338 filed 23 Jan. 2014 and claiming the priority of German patent application 102013102299.5 itself filed 8 Mar. 2013.

FIELD OF THE INVENTION

The invention relates to a linear selector for power-free preselection of tap contacts of a tapped transformer.

BACKGROUND OF THE INVENTION

A step regulating device for transformers is known from DE 913 933 and has a motor drive that drives a load switch and two tap selectors. Whereas one of the tap selectors preselects the uneven-numbered taps of the transformer, the other is responsible for preselection of the even-numbered taps. The actual switching over under load is carried out by the load switch. Each of the tap selectors has a slide that runs along a guide and that is driven by a traction element that runs over deflecting rollers, via an entraining formation seated at this element. Each slide carries switch contacts by which an electrically conductive connection between a contact rail and the taps of the transformer can be produced.

The individual selectors are actuated in alternation and the taps of the transformer changed by a discontinuous transmission. On reaching a specific tap, the roller of a lever that is attached to the transmission element, engages in the groove of a disk that is connected with the reverser, and thus actuates this.

A disadvantage of the existing step regulating device is the use of two individual selectors. These not only require a large amount of constructional space, but also impose high demands on the connection with the discontinuous transmission. The two selectors each need an individual guide, an individual slide and an individual traction element inclusive of bearings. Moreover, the coupling of the reverser to the selector as well as the actuation thereof is complex and susceptible to fault. The solution realized here by a lever with rollers—that in addition is at only one traction element—represents a high level of maintenance effort due to the numerous movable parts. Many errors can arise already during assembly in the case of numerous individual parts of that kind.

OBJECT OF THE INVENTION

The object of the invention is to provide a linear selector for power-free preselection of tap contacts of a tapped transformer, which selector is of economic, simple and compact construction.

SUMMARY OF THE INVENTION

This object is fulfilled according to the invention by a linear selector for power-free preselection of tap contacts of a tapped transformer having a fine selector with uneven-numbered tap contacts in a first row and even-numbered tap contacts in a second row, a reversing switch having a shaft carrying first and second contact fans, and a transmission that directly actuates a single contact slide to contact the uneven-numbered tap contacts and the even-numbered tap contacts of the fine selector and the first and second contact fan seated on the shaft of the reversing switch.

The general inventive idea consists of constructing a linear selector from a fine selector and a reversing switch and driving these by a common transmission. In that case, the linear selector carries the transmission that contacts uneven-numbered tap contacts and even-numbered tap contacts of the fine selector by a single contact slide and directly actuates a first contact fan and second contact fan that are seated on a shaft of the reversing switch.

In accordance with one form of embodiment according to the invention the transmission consists of a Geneva wheel, a first bevel gear and a second bevel gear, wherein the Geneva wheel is connected with the first bevel gear by a connecting shaft to be secure against relative rotation and the second bevel gear is seated on a traction means shaft and is drivable by the first bevel gear.

In addition, the Geneva wheel consists of a Maltese cross seated on a disk to be secure against relative rotation, which disk carries at the circumference at a side remote from the Maltese cross a cam that co-operates with a groove of a fork of the shaft of the first contact fan and the second contact fan of the reversing switch.

Pivoting of the shaft is produced by engagement of the cam in the groove of the fork of the shaft of the first contact fan and the second contact fan of the reversing switch.

In accordance with a further form of embodiment according to the invention the continuously rotating driver carries a plurality of rollers that so co-operate with the Maltese cross of the Geneva wheel that a stepped movement of the Geneva wheel can be produced.

The stepped movement of the Geneva wheel is transmitted by the connecting shaft to the first bevel gear and the second bevel gear, whereby via a traction means of the contact slide this slide is linearly actuated in steps by the traction means shaft.

The traction means has an entraining pin, wherein the entraining pin is mechanically fixedly connected with the contact slide in such a way that the contact slide is moved in vertical direction by the traction means.

The contact slide has a first contact arm with a sliding contact pair and a second contact arm with a sliding contact pair, wherein an electrically conductive connection between the vertically spaced uneven-numbered tap contacts and a first diverter contact can be produced by the first contact arm and the sliding contact pair thereof and an electrically conductive connection between the vertically spaced even-numbered tap contacts and a second diverter contact can be produced by the second contact arm via the sliding contact pair thereof.

An electrically conductive connection is produced between one of the uneven-numbered tap contacts and the first diverter contact and/or between one of the even-numbered tap contacts and the second diverter contact through the stepped vertical movement of the contact slide via the traction means.

In that regard, the first contact fan and the second contact fan of the reversing switch are at the shaft to be axially offset. The first contact fan and the second contact fan each have a respective sliding contact pair, wherein three reversing contacts in a horizontal plane of a first arcuate curve are associated with the first contact fan and three reversing contacts in a horizontal plane of a second arcuate curve are associated with the second contact fan.

Realisation of the actuation of the reversing switch by the same transmission as for actuation of fine selector is particularly advantageous in the case of the linear selector according to the invention. Costs for production and maintenance of the linear selector are thereby reduced.

Earlier reversing switches with constant potential coupling always required a complex reversing transmission in the fine selector. Accordingly, simple reversers with additional poling resistances, which similarly required much constructional space, were preferred. Since the reversing switch in the linear selector is of very simple construction, this can always be preferred to the simple reverser with poling resistances.

Moreover, a particularly large amount of constructional space in the transformer housing is saved by the linear arrangement of the fine selector in the linear selector. The particularly compact design of the reversing switch also promotes this advantage. Overall, the linear selector according to the invention can be closer to the windings of the transformer. In addition, the required amount of insulating oil for cooling the transformer is reduced by the compact linear selector.

BRIEF DESCRIPTION OF THE DRAWING

These and other features and advantages of the various forms of embodiment disclosed here are more readily understandable with reference to the accompanying description and drawings, in which the same reference numerals throughout denote the same elements and in which.

SPECIFIC DESCRIPTION OF THE INVENTION

Figure 1:
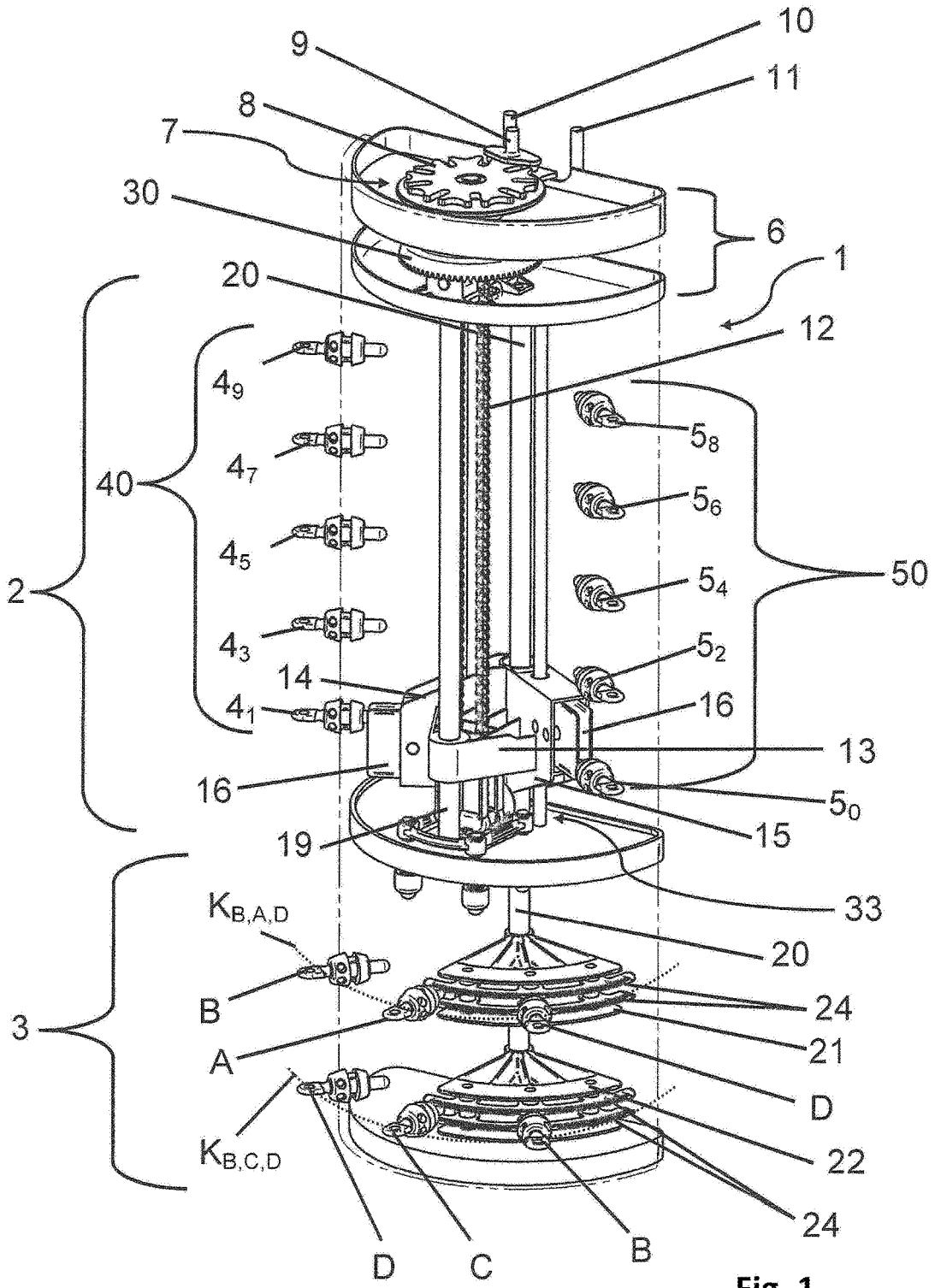
FIG. 1 is a perspective exploded view of a linear selector according to the invention.
Figure 5:
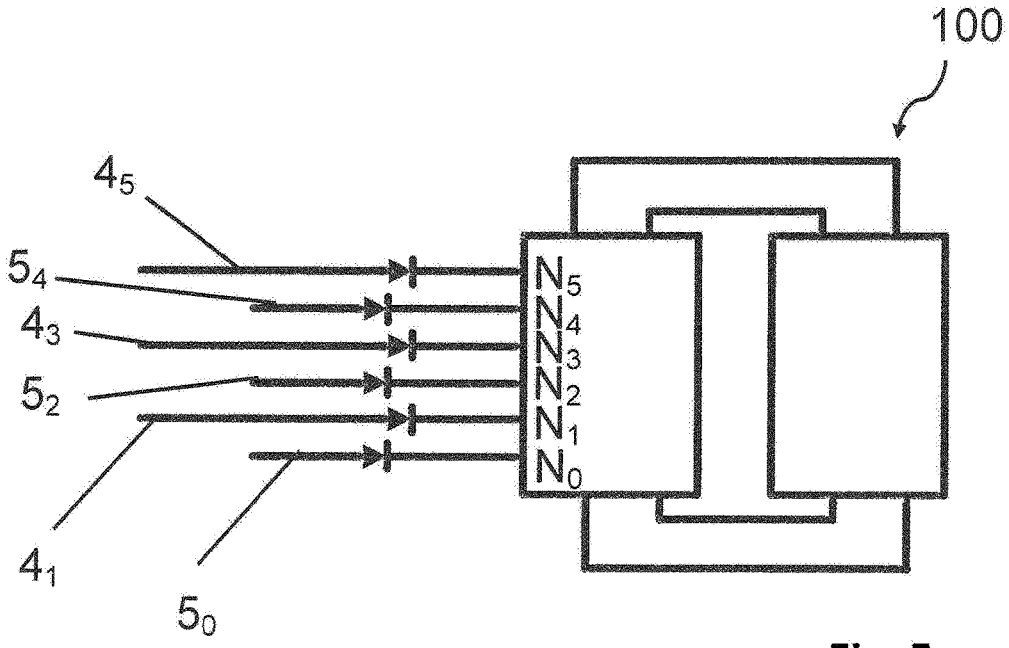
FIG. 5 is a schematic view of the tapped transformer with the linear selector.

A linear selector 1 according to the invention having a fine selector 2 and a reversing switch 3 is depicted in FIG. 1. The fine selector 2 has two rows of vertically spaced tap contacts $\mathbf{4}_1$, $\mathbf{4}_3$, $\mathbf{4}_5$, . . . ; $\mathbf{5}_0$, $\mathbf{5}_2$, $\mathbf{5}_4$, . . . . A first row 40 carries the uneven-numbered tap contacts $\mathbf{4}_1$, $\mathbf{4}_3$, $\mathbf{4}_5$, . . . and a second row 50 carries the even-numbered tap contacts $\mathbf{5}_0$, $\mathbf{5}_2$, $\mathbf{5}_4$, . . . that are all inserted into a wall 37 of the linear selector 1. This wall 37 is constructed as a segment of a cylinder, but can also consist of a plurality of rods arranged in a semicircle. Those contacts that are connected with the uneven-numbered winding taps $N_1$, $N_3$, $N_5$, . . . of a tapped transformer 100 are regarded as uneven-numbered tap contacts $\mathbf{4}_1$, $\mathbf{4}_3$, $\mathbf{4}_5$, . . . . Those contacts that are connected with the even-numbered winding taps $N_0$, $N_2$, $N_4$, . . . of the tapped transformer 100 are regarded as even-numbered tap contacts $\mathbf{5}_0$, $\mathbf{5}_2$, $\mathbf{5}_4$, . . . (see FIG. 5). A transmission 6 is above the fine selector 2. In the illustration shown here it can be seen that the transmission 6 has a Geneva wheel 7, in which a Maltese cross 8 is seated on a disk 35 and connected therewith to be secure against relative rotation. The Maltese cross 8 is driven by a driver 9. The drive for the driver 9 is an electric motor (not illustrated here) that can be designed in the form of a three-phase alternating-current motor. In addition, the linear selector 1 has a first diverter contact 10 and a second diverter contact 11. The diverter contacts 10 and 11 run parallel to one another to a load changeover switch (not illustrated here).

A further component of the fine selector 2 is a traction means 12 that is mechanically coupled with a contact slide 13. The traction means 12 can be a chain, a cogged belt or similar. A detailed depiction of the contact slide 13 is illustrated in section in FIG. 2.

Figure 2:
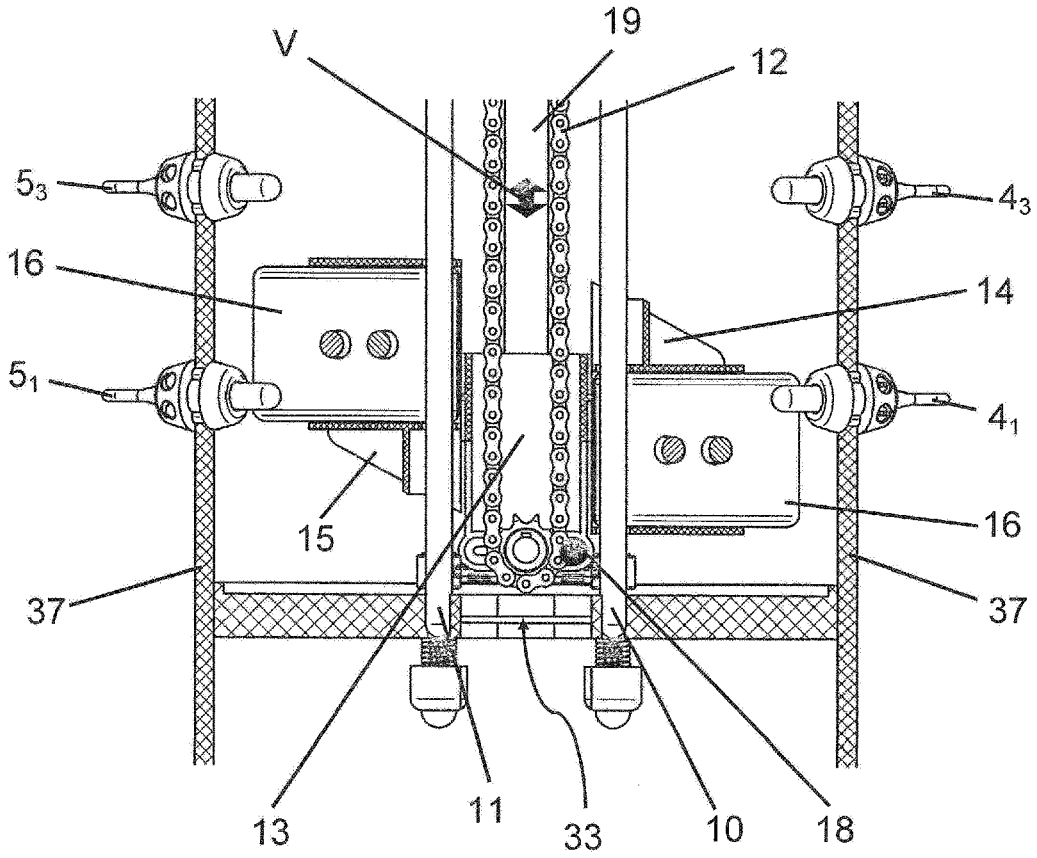
FIG. 2 is a large-scale sectional view of the contact slide of the linear selector.

As can be seen in FIGS. 1 and 2, the contact slide 13 carries a first contact arm 14 and a second contact arm 15. Each contact arm 14, 15 has a sliding contact pair 16. The contact slide 13 can be moved up and down in a vertical direction V in the linear selector 1 by the traction means 12. When movement of the contact slide 13 takes place the first contact arm 14 contacts the uneven-numbered tap contacts $\mathbf{4}_1$, $\mathbf{4}_3$, $\mathbf{4}_5$, . . . of the linear selector 1 by the sliding contact pair 16 and the second contact arm 15 contacts the even-numbered tap contacts $\mathbf{5}_0$, $\mathbf{5}_2$, $\mathbf{5}_4$, . . . of the linear selector 1 by its sliding contact pair 16. As can be seen from FIG. 2, an entraining pin 18 by which the contact slide 13 is moved or entrained is at the traction means 12. In addition, the fine selector 2 has a guide 19 with the help of which the contact slide 13 is guided in the case of movement in vertical direction V.

As can be further seen in FIG. 1, the linear selector 1 also consists of a reversing switch 3 that co-operates with the transmission 6 by a shaft 20. A first contact fan 21 and a second contact fan 22 are at the shaft 20. The first and second contact fans 21, 22 are mounted one above the other at a mutual spacing in axial direction on the shaft 20. The first contact fan 21 has a sliding contact pair 24 and the second contact fan 22 similarly has a sliding contact pair 24. The first contact fan 21 and the second contact fan 22 each have the shape of a segment of a circle, wherein each sliding contact pair 24 is provided at the respective segment curve. Three reversing contacts A, B, D are associated with the first contact fan 21 and are so arranged along an arcuate curve $K_{BAD}$ that they are contacted by the sliding contact pair 24 of the first contact fan 21 in the case of pivot movement thereof. Similarly, three reversing contacts B, C, D are associated with the second contact fan 22 and are so arranged along an arcuate curve $K_{DCB}$ that they are contacted by the sliding contact pair 24 of the second contact fan 22 in the case of pivot movement thereof. During operation of the linear selector 1 always at least two of the reversing contacts B, A, D and two of the reversing contacts D, C, B are electrically conductively connected together by the sliding contact pair 24 of the first contact fan 21 or the second contact fan 22. The reversing contacts A, B, C, C are similarly mounted in the wall 37.

Figure 3:
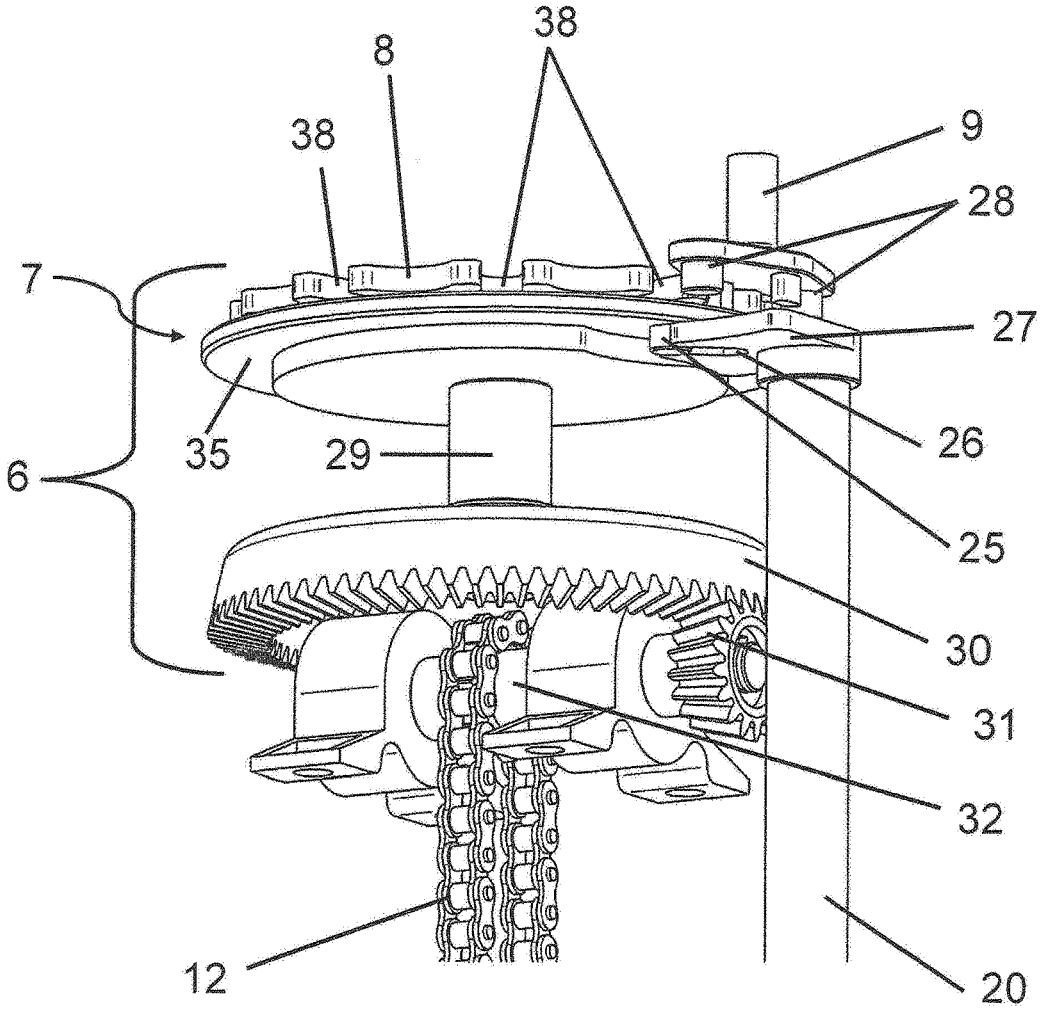
FIG. 3 is a perspective detail view of the transmission for connecting the contacts of the linear selector.

A detail view of the transmission 6 of the linear selector 1 is depicted in FIG. 3. The transmission 6 essentially consists of a Geneva wheel 7, a first bevel gear 30 and a second bevel gear 31. The Geneva wheel 7 is connected with the first bevel gear 30 by a connecting shaft 29 to be secure against relative rotation. The second bevel gear 31 is mechanically connected with the first bevel gear 30 by meshing engagement, wherein the second bevel gear 31 is seated on a traction means shaft 32. The Geneva wheel 7 consists of a Maltese cross 8 that is seated on a disk 35 to be secure against relative rotation. The disk 35 carries a cam 25 at the circumference at a side remote from the Maltese cross 8. The cam 25 co-operates with a groove 26 of a fork 27 of the shaft 20 of the first contact fan 21 and the second contact fan 22 of the reversing switch 3. The cam 25 temporarily engages in the groove 26 of the fork 27 in dependence on the rotational movement of the Geneva wheel 7. This takes place when the Geneva wheel 7 reaches a specific setting when rotating. During this process pivot movement of the fork 27 takes place and thereby pivot movement of the shaft 20 connected therewith, the pivot movement of which in turn results in pivoting of the first contact fan 21 and the second contact fan 22.

As already mentioned, the driver 9 is continuously driven. Through the continuous rotational movement of the driver 9 the rollers 28 fastened thereto alternately come into engagement with grooves 38 of the Maltese cross 8. A stepped rotational movement of the Geneva wheel 7 arises due to the alternating engagement in the grooves 38 of the Maltese cross 8.

The Geneva wheel 7 is connected with the first bevel gear 30 by the connecting shaft 29 to be secure against relative rotation, so that the stepped movement of the Geneva wheel 7 is transmitted to the first bevel gear 30. The first bevel gear 30 transmits the stepped movement to the second bevel gear 31. The second bevel gear 31 is in mechanical connection with a traction means shaft 32. Transmission of the stepped movement of the Geneva wheel 7 to the contact slide 13 takes place through a mechanically positive connection between the traction means 12 and the traction means shaft 32.

During the preselection process an uneven-numbered tap contact $\mathbf{4}_1$, $\mathbf{4}_3$, $\mathbf{4}_5$, . . . or an even-numbered tap contact $\mathbf{5}_0$, $\mathbf{5}_2$, $\mathbf{5}_4$, . . . is always connected with one of the diverter contacts 10 or 11 with the help of the contact slide 13. In that case, the contact slide 13 travels in vertical direction from above to below or conversely depending on the rotational direction of the driver 9 and in that event connects the different uneven-numbered tap contacts $\mathbf{4}_1$, $\mathbf{4}_3$, $\mathbf{4}_5$, . . . and/or the even-numbered tap contacts $\mathbf{5}_0$, $\mathbf{5}_2$, $\mathbf{5}_4$, . . . with the respective diverter contact 10 or 11. The electrically conductive connection in that case arises on each occasion through the sliding contact pair 16 of the first contact arm 14 or second contact arm 15 that on the one hand touch or contact the uneven-numbered tap contacts $\mathbf{4}_1$, $\mathbf{4}_3$, $\mathbf{4}_5$, . . . or the even-numbered tap contacts $\mathbf{5}_0$, $\mathbf{5}_2$, $\mathbf{5}_4$, . . . and on the other hand the diverter contact 10, 11. This form of embodiment ensures that at least one electrically conductive connection is present between either an uneven-numbered tap contact $\mathbf{4}_1$, $\mathbf{4}_3$, $\mathbf{4}_5$, . . . and the first diverter contact 10 or an even-numbered tap contact $\mathbf{5}_0$, $\mathbf{5}_2$, $\mathbf{5}_4$, . . . and the second diverter contact 11.

On travel of the uneven-numbered tap contacts $\mathbf{4}_1$, $\mathbf{4}_3$, $\mathbf{4}_5$, . . . and the even-numbered tap contact $\mathbf{5}_0$, $\mathbf{5}_2$, $\mathbf{5}_4$, . . . entirely from the top to entirely the bottom, i.e. from the transmission 6 to the reversing switch 3, the taps (windings) of the tapped transformer 100 are switched on and off depending on the respective wiring. On reaching a lower reversing point 33, the reversing switch 3 is actuated by the shaft 20 connected with the transmission 6 so that before the contact slide 13 continues its movement upwardly in the opposite direction the reversing switch 3 performs the switching and the taps of the tapped transformer 100 are switched on or off again.

By contrast to a simple reverser that connects the regulating winding of a tapped transformer against or toward the regulating winding and in that case electrically separates it from the main winding the reversing switch 3 ensures by the first contact fan 21 and the second contact fan 22 a constant potential coupling of the regulating winding so that this is not separated from the main winding at any point in time. Reversing switches 3 of that kind with reversing contacts on two planes are also termed double reversers.

Figure 4A:
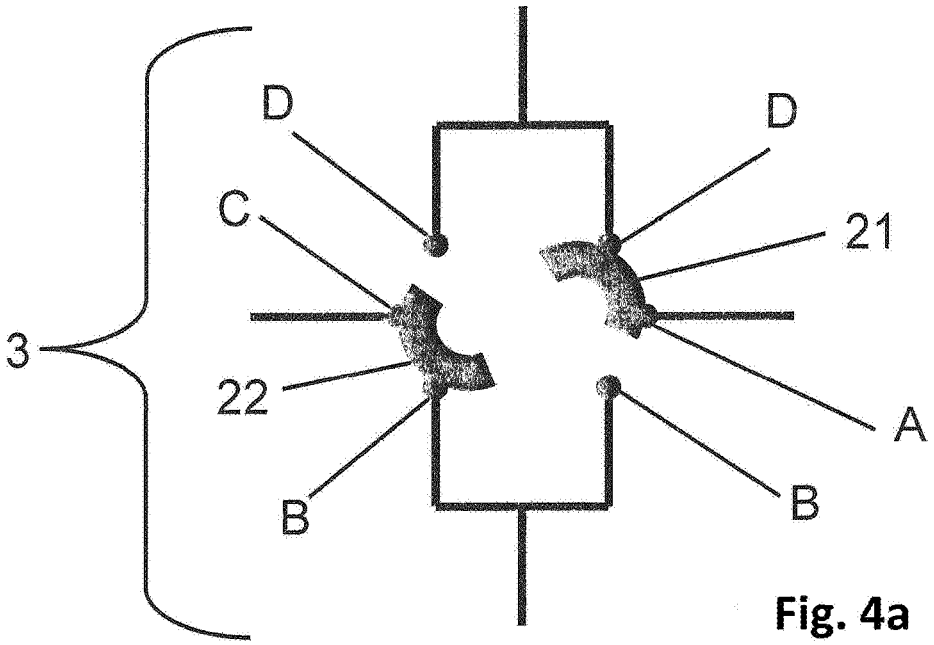
FIGS. 4*a*-4*c* are diagrammatic views showing the switching sequence of the reversing switch.
Figure 4B:
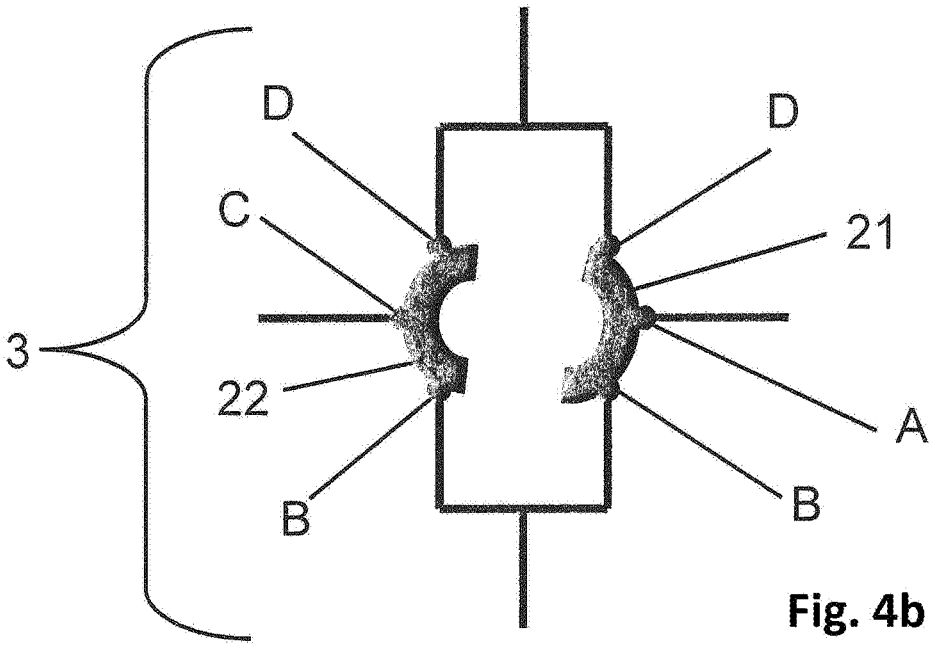
Figure 4C:
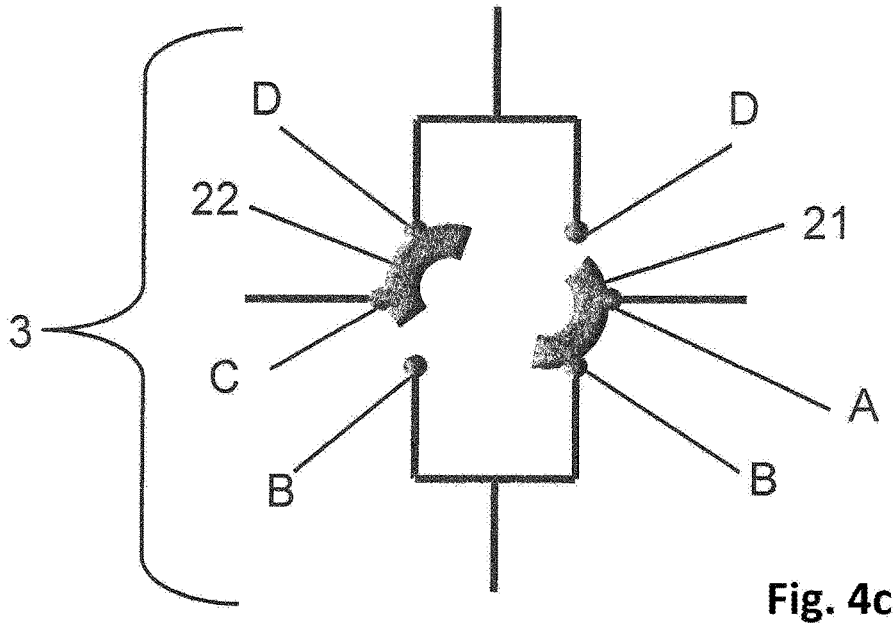

As illustrated in FIGS. 4*a*-4*c*, the first contact fan 21 and the second contact fan 22 are pivoted from the starting position, in which the first contact fan 21 electrically conductively connects the first reversing contacts A and D together and the second contact fan 22 electrically conductively connects the first reversing contact B and C together. When the pivot movement takes place, as is illustrated in FIG. 4*b* the first contact fan 21 and the second contact fan 22 initially electrically conductively contact all reversing contacts B, A, D of the first arcuate curve $K_{BAD}$ or all reversing contacts D, C, B of the second arcuate curve $K_{DCB}$ and connect these together. Subsequently, the first contact fan 21 and the second contact fan 22 are pivoted further until the first contact fan 21 electrically conductively connects the reversing contacts A and B together and the second contact fan 22 electrically conductively connects the reversing contacts C and D together, as can be seen in FIG. 4*c*.

The invention claimed is:

1. A linear selector for power-free preselection of tap contacts of a tapped transformer comprising:

a fine selector comprising uneven-numbered tap contacts in a first row and even-numbered tap contacts in a second row, a reversing switch having a switch shaft carrying a first contact fan and a second contact fan; and a transmission that directly actuates a single contact slide to contact the uneven-numbered tap contacts and the even-numbered tap contacts of the fine selector and the first and second contact fans on the switch shaft of the reversing switch.

2. The linear selector according to claim 1, wherein the transmission comprises:

a Geneva wheel, a first bevel gear, a second bevel gear drivable by the first bevel gear, a transmission shaft fixedly connecting the Geneva wheel and the first bevel gear for joint rotation, and traction means carrying the second bevel gear.

3. The linear selector according to claim 2, wherein the Geneva wheel consists of a Maltese cross that is fixedly seated against relative rotation on a disk that carries at the circumference at a side remote from the Maltese cross a cam that co-operates with a groove of a fork of the switch shaft of the first contact fan and the second contact fan of the reversing switch.

4. The linear selector according to claim 3, wherein the switch shaft is pivoted by the cam on engagement in the groove of the fork of the switch shaft of the first contact fan and the second contact fan of the reversing switch.

5. The linear selector according to claim 2, further comprising:

a continuously rotating driver that carries a plurality of rollers that so co-operate with the Maltese cross of the Geneva wheel such that a stepped movement of the Geneva wheel can be produced.

6. The linear selector according to claim 5, wherein the stepped movement of the Geneva wheel is transmissible by the transmission shaft to the first bevel gear and the second bevel gear and the traction means of the contact slide is linearly actuatable in steps by the traction means shaft.

7. The linear selector according to claim 6, wherein the traction means has an entraining pin that is so mechanically fixedly connected with the contact slide that the contact slide is movable vertically by the traction means.

8. The linear selector claim 1, wherein the contact slide has a first contact arm with a sliding contact pair and a second contact arm with a sliding contact pair such that an electrically conductive connection between the vertically spaced uneven-numbered tap contacts and a first diverter contact is producible by the first contact arm and the sliding contact pair thereof and an electrically conductive connection between the vertically spaced even-numbered tap contacts and a second diverter contact is producible by the second contact arm by the sliding contact pair thereof.

9. The linear selector according to claim 8, wherein an electrically conductive connection between one of the uneven-numbered tap contacts and the first diverter contact and/or between one of the even-numbered tap contacts and the second diverter contact is producible by stepped vertical movement of the contact slide via the traction means.

10. The linear selector according to claim 1, wherein the first contact fan and the second contact fan of the reversing switch are axially offset on the switch shaft, the first contact fan and the second contact fan each having a respective sliding contact pair, the selector further comprising:

three reversing contacts in a horizontal plane of a first arcuate curve and associated with the first contact fan, and three reversing contacts in a horizontal plane of a second arcuate curve and associated with the second contact fan.

* * * * *